United States Patent [19]

Schwandt et al.

[11] 3,999,511

[45] Dec. 28, 1976

[54] APPARATUS FOR DEVELOPING ELECTROPHOTOGRAPHIC MATERIALS

[75] Inventors: Rudi Schwandt, Wiesbaden-Erbenheim; Dieter Topfer, Wiesbaden-Biebrich, both of Germany

[73] Assignee: Hoechst Aktiengesellschaft, Frankfurt am Main, Germany

[22] Filed: May 27, 1975

[21] Appl. No.: 581,040

[30] Foreign Application Priority Data

May 28, 1974 Germany ..... 183929

[52] U.S. Cl. ..... 118/109; 355/10; 354/318; 118/116; 118/119; 118/259

[51] Int. Cl.[2] ..... B05C 3/04; B05C 3/08

[58] Field of Search ..... 118/637, 119, 116, 118, 118/117, 109, 110, 259; 427/15; 355/10; 354/318, 317

[56] References Cited

UNITED STATES PATENTS

| | | | |
|---|---|---|---|
| 3,180,115 | 4/1965 | Marshall | 66/170 |
| 3,448,720 | 6/1969 | Graham | 118/DIG. 23 |
| 3,732,808 | 5/1973 | Graham | 118/DIG. 23 |
| 3,905,332 | 9/1975 | Sawada et al. | 118/637 |

*Primary Examiner*—Ronald Feldbaum
*Attorney, Agent, or Firm*—Richard L. Schwaab

[57] ABSTRACT

An improved apparatus is disclosed for developing images on an electrophotographic copy sheet, characterized by the provision of a distribution roller having a soft porous peripheral surface for evenly spreading the toner dispersion on the electrophotographic copy sheet. The distribution roller is arranged between pairs of in-feed and squeeze roller means arranged in the developing chamber for transporting the electrophotographic sheet therethrough. Improved spray tube means are also provided for spraying the toner dispersion uniformly upon the peripheral surface of the upper in-feed roller.

9 Claims, 2 Drawing Figures

APPARATUS FOR DEVELOPING ELECTROPHOTOGRAPHIC MATERIALS

BRIEF DESCRIPTION OF THE PRIOR ART

This invention relates to an apparatus for developing electrophotographic copying materials, in particular electrophotographic printing plates, by means of liquid toner dispersions.

In the German Offenlegungsschriften Nos. 1,597,820 and 2,331,253, developing apparatuses for electrophotographic copying materials are disclosed in which the material provided with the charge image is passed through a developing zone in which the toner dispersion is applied to the surface carrying the charge image. The dispersion may be applied in such a manner that the upper one of a pair of in-feed rollers is evenly wetted with toner dispersion from above. Thus the roller applies a uniform film of toner dispersion upon the copying material. At the end of the developing zone, a pair of squeeze rollers are provided which squeeze the superfluous liquid off the surface of the material.

The known developing apparatuses have the disadvantages that the application of the toner to the in-feed roller is not achieved evenly enough under all conditions, and that the toner covering of larger solids is not sufficiently uniform.

SUMMARY OF THE INVENTION

Accordingly, the present invention was developed to provide an apparatus of the kind referred to above which makes possible a more complete and uniform development of the charge image by the simplest means possible.

A primary object of the present invention is to provide an improved apparatus for developing electrophotographic copying materials by means of a liquid toner dispersion, characterized by the provision of a rotatably mounted dispersion roller arranged in the developing chamber between the in-feed and the squeeze roller pairs for evenly distributing the toner dispersion upon the electrophotographic copy sheet. At least the outer peripheral surface of the distribution roller is formed of a soft porous material, such as nylon velour, a plush material or the like. Preferably the distribution member includes a cylindrical metal core connected with electrical ground.

According to another object of the invention, in order to further assure an even distribution of the toner dispersion on the electrophotographic copy sheet, improved spray means are provided for spraying the toner dispersion on the surface of the upper in-feed roller. More particularly, the spray means includes a tubular toner dispersion applying member which extends parallel with and longitudinally in spaced relation above the upper in-feed roller, the lower portion of the tubular member containing longitudinal rows of apertures arranged on opposite sides of the vertical plane which contains the longitudinal axis of the tubular member. Preferably the rows of apertures are contained in planes which are arranged at an angle of from 5° to 15° to the vertical longitudinal plane of the tubular member. The toner dispersion liquid is supplied within the tubular member via an inner tubular member arranged in concentrically spaced relation therein, said inner tubular member containing for example diametrically arranged horizontal rows of apertures contained in a horizontal plane that contains the longitudinal axis of the inner tubular member.

According to a more specific object of the invention, the distribution roller includes a grounded metal core and a peripheral surface layer formed of close-meshed textile fabrics like nylon velours or plush, felt and the like. The roller is preferably a freely rotatable non-driven roller which rolls freely over the surface of the material to be developed when it is fed thereby. Thus a uniform distribution of the toner is achieved, even on larger solids of the image. If desired, the distribution roller may be driven for rotation either at the same peripheral speed as or at a peripheral speed different from, the passing speed of the copying material.

For the application of the toner dispersion to the upper in-feed roller a spray tube is preferably used which is arranged above the roller and is parallel to it. The tube preferably has two rows of circular apertures in its lower part through which the liquid is sprayed onto the surface of the in-feed roller. It is useful to arrange these rows in the tube jacket at an angle of 5° to 15° to the mid-vertical of the tube. Thus a completely uniform wetting of the roller surface on both sides is guaranteed, even if passing speeds differ. If desired, the apertures may be slotted in a corresponding arrangement instead of the rows of circular holes.

The superfluous toner dispersion running off the copying material is collected in a collecting vessel arranged in the bottom of the developing chamber and is mixed therein, whereupon it is pumped back into the spray tube.

The in-feed roller used for the application of the toner preferably has a smooth surface which suitably consists of a synthetic or plastic coating, such as polyvinyl chloride, which is well wetted by the solvent of the toner dispersion.

The upper squeeze roller which touches the image side preferably has a hard and smooth surface, e.g. a surface composed of a suitable ceramic material.

Suitable guiding means for the copying material in the developing zone include synthetic or plastic plates having little static friction, or non-corroding metal plates which may be corrugated in the longitudinal direction in order to reduce the static friction.

The apparatus according to the invention is suitable for developing charge images on various electrophotographic materials, e.g. on zinc oxide paper, photoconductive films, or metal films provided with photoconductive layers. It is preferably used for developing electrophotographic printing plates which consist of a metal carrier having a photoconductive layer, or printing plates as described in German Pat. No. 1,117,391 or in German Auslegeschrift No. 1,522,497.

BRIEF DESCRIPTION OF THE DRAWING

Other objects and advantages of the invention will become apparent from a study of the following specification when viewed in the light of the accompanying drawing, in which.

DETAILED DESCRIPTION

Figure 1:
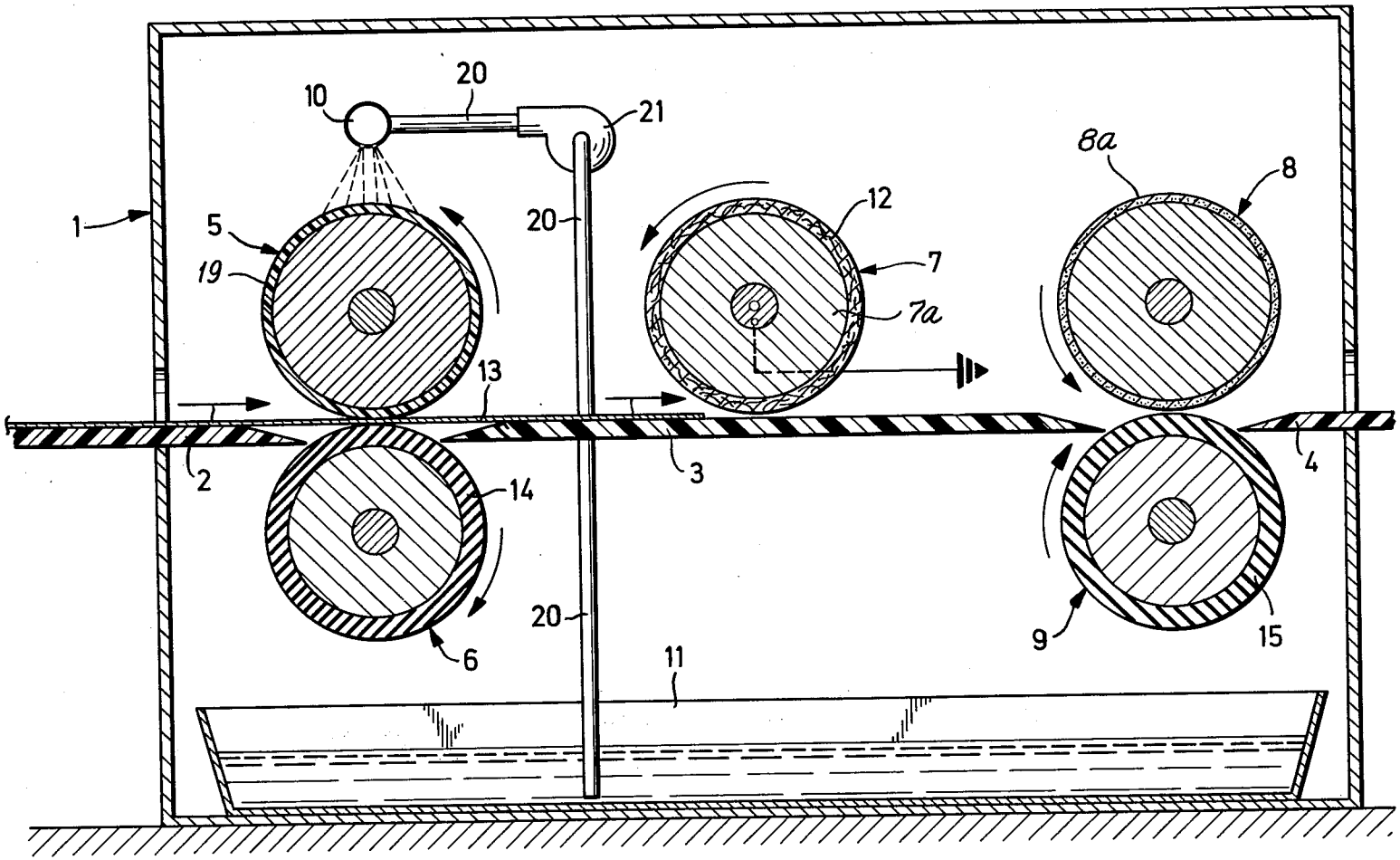
FIG. 1 is a longitudinal sectional view of a first embodiment of the invention.

Referring more particularly to FIG. 1, the developing chamber housing 1 includes stationary horizontal in-feed, mid-feed and delivery guide plates which are formed, for example, of a suitable synthetic plastic material and are arranged at the same level. At the entrance and exit openings of the developing chamber are arranged in-feed rollers 5 and 6 and squeeze rollers 8 and 9, respectively. Between these pairs of rollers and above the guiding plate 3 there is provided a freely rotatably non-driven distribution roller 7 having a grounded metal core 7*a* and on this core is concentrically mounted a peripheral coating layer 12 consisting of nylon velours, plush material, felt, velvet, chenille, shag or the like.

The electrophotographic printing sheet or plate 13 which is to be developed is introduced in the nip between the rollers 5 and 6 via the in-feed plate 2 and, with the side carrying the charge image showing upwards, is seized by these rollers and transported through the developing chamber in the direction of the arrow.

The roller 5 is uniformly sprayed with toner dispersion supplied via the spray tube 10. Thus the surface of the roller 5, which has a coating 19 composed of polyvinyl chloride, is coated with a uniform liquid film which is transferred onto that side of the printing plate which carries the charge image. When the front edge of the printing plate reaches the distribution roller 7 it causes the roller to rotate because of the friction at the velours coating, so that this roller rolls over the entire surface of the plate and thus distributes the toner dispersion evenly on all the image areas. The plate is then seized by the squeeze rollers 8 and 9 and transported onto the delivery plate 4. The nip between the rollers 8 and 9 is adjustable and is adjusted in such a manner that most of the superfluous toner dispersion and of the solvent of the toner dispersion is squeezed off, so that the plate is almost dry when it leaves the developing chamber. The peripheral surface of the upper squeeze roller 8 preferably includes a layer 8*a* of a ceramic material, whereas the lower squeeze roller 9 and the in-feed roller 6 have peripheral coating layers 15 and 14, respectively, of a resilient material, such as rubber or the like.

The excess toner dispersion runs by gravity into the collecting vessel 11 and is pumped back therefrom through the pipe 20 via the pump 21 into the spray tube 10.

Figure 2:
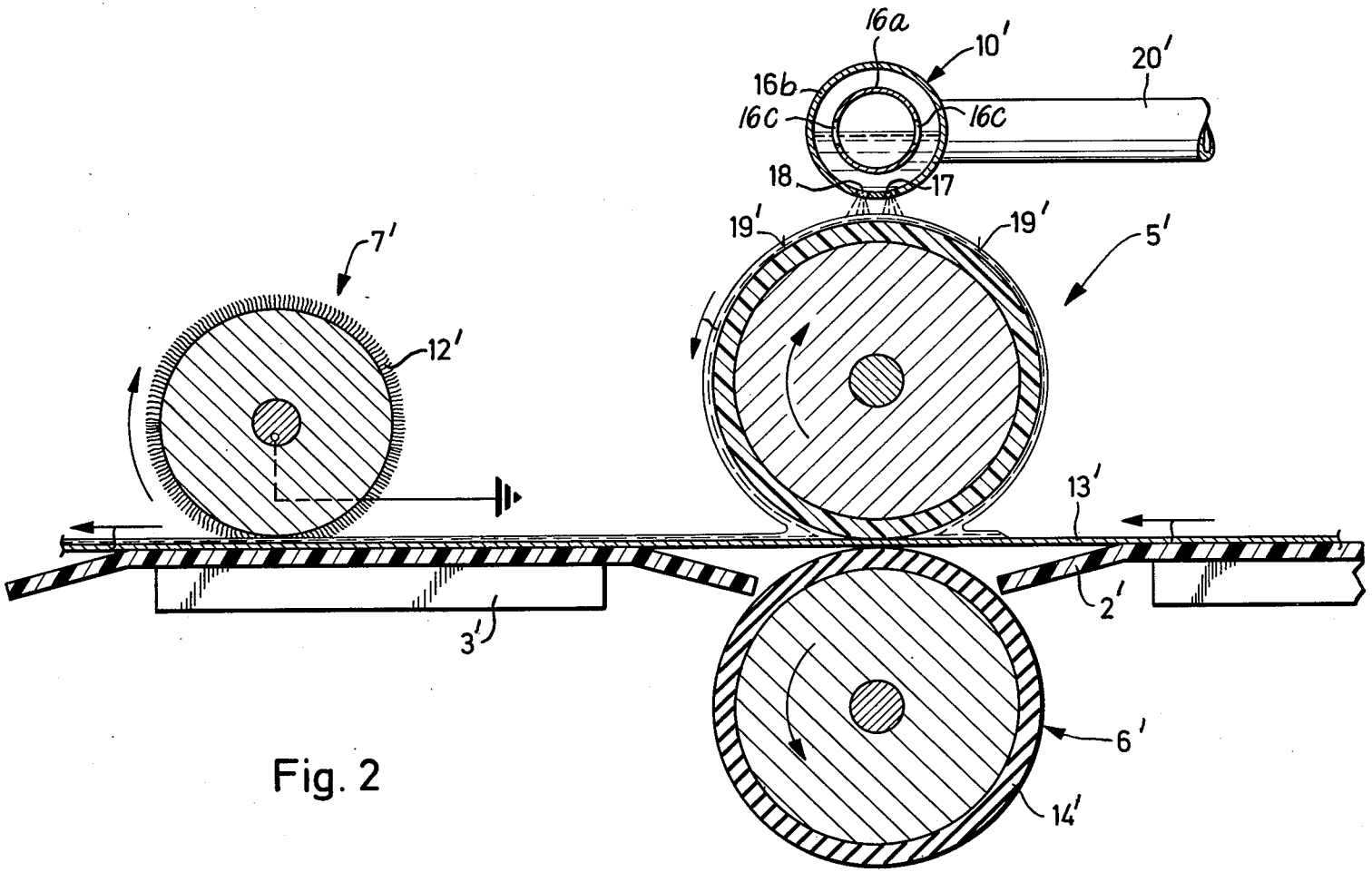
FIG. 2 is a detailed sectional view of a slightly modified version of the apparatus of FIG. 1.

FIG. 2 illustrates a preferred embodiment of the spray tube means 10' including concentrically spaced inner and outer tubular members 16*a* and 16*b*, respectively. The inner tubular member 16*a* contains two diametrically arranged rows of horizontal apertures 16*c*, and the bottom portion of the outer tubular member 16*b* contains two rows of apertures 17 and 18 each of which is arranged on the periphery of the tube at an angle of from 5° to 15° (preferably about 10°) to the mid-vertical. This arrangement of the apertures causes a particularly even distribution of the liquid film on the surface 19' of the in-feed roller 5'. Toner dispersion pumped to the inner tubular member 16*a* via conduit 20' is emitted from the inner tubular member 16*a* via apertures 16*c* and from the outer tubular member via apertures 17 and 18.

While in accordance with the Patent Statutes the preferred forms and embodiments of the invention have been illustrated and described, it will be apparent that various modifications may be made in the apparatus described without deviating from the inventive concepts set forth above.

What is claimed is:

1. An apparatus for developing by means of a liquid toner dispersion an electrophotographic sheet having at least an electrophotographic surface layer and an electrostatic charge image on the electrophotographic surface, said apparatus comprising: (a) a housing defining a developing chamber, said housing having opposed vertical walls containing opposed entrance and exit openings for the sheet, respectively; (b) pairs of rotatably driven in-feed and squeeze rollers arranged in mid chamber adjacent said entrance and exit openings, respectively; (c) means for applying toner dispersion to the upper one of said in-feed rollers; (d) guide means for guiding the sheet during its transport between the in-feed and squeeze rollers; (e) a collecting vessel arranged in the bottom of the chamber for receiving excess toner dispersion; (f) means for supplying the toner dispersion from the vessel to the toner dispersion applying means; (g) roller means rotatably mounted in the developing chamber between said in-feed and squeeze rollers for distributing the toner dispersion upon the electrophotographic sheet, said distributing roller means comprising on at least its peripheral surface a soft porous close-meshed textile fabric, and said distributing roller means further comprising a metal core, and means for connecting said metal core with electrical ground.

2. Apparatus as defined in claim 1, wherein the peripheral surface portion of said distribution roller consists of nylon velour.

3. Apparatus as defined in claim 1, wherein the peripheral surface portion of said distribution roller consists of a plush material.

4. Apparatus as defined in claim 1, wherein said distribution roller comprises a non-driven roller connected for free rotation relative to the housing and adapted to be driven by contact with the sheet.

5. Apparatus as defined in claim 1, wherein the toner dispersion applying means comprises spray tube means.

6. Apparatus as defined in claim 5, wherein said spray tube means includes a horizontal tubular member arranged above and parallel with the axis of the upper one of the in-feed follers, the lower portion of said tubular member containing two longitudinal rows of apertures arranged on opposite sides of the vertical plane containing the longitudinal axis of said tubular member.

7. Apparatus as defined in claim 6, wherein each of the rows of apertures is contained in a plane arranged at an angle of from 5° to 15° to the vertical plane.

8. Apparatus as defined in claim 7, and further including an inner tubular member arranged in concentrically spaced relation within the horizontal tubular member, and means for supplying toner dispersion to said inner tubular member, said inner tubular member containing diametrically arranged longitudinal rows of apertures contained in the horizontal plane which contains the longitudinal axis of the inner tubular member.

9. Apparatus as defined by claim 4, wherein said distribution roller is further adapted to be driven at the same peripheral speed as the speed of the sheet.

* * * * *

UNITED STATES PATENT OFFICE

CERTIFICATE OF CORRECTION

Patent No. 3,999,511 Dated December 28, 1976

Inventor(s) Rudi SCHWANDT and Dieter Töpfer

It is certified that error appears in the above-identified patent and that said Letters Patent are hereby corrected as shown below:

On the cover page, please correct the inventor's name to read -- Töpfer --;

Under "[30] Foreign Application Priority Data", please correct the foreign application number to read -- G 74 18 392.9 --;

Claim 6, line 44, please change "follers" to -- rollers --.

Signed and Sealed this

Seventeenth Day of May 1977

[SEAL]

*Attest:*

RUTH C. MASON
*Attesting Officer*

C. MARSHALL DANN
*Commissioner of Patents and Trademarks*